US006105346A

United States Patent [19]

Hsi-Chang

[11] Patent Number: 6,105,346

[45] Date of Patent: Aug. 22, 2000

[54] ROTATABLE, ADJUSTABLE-WIDTH BAR BIT

[75] Inventor: Chang Hsi-Chang, Taichung, Taiwan

[73] Assignee: Eastwest International Enterprises, Taichung, Taiwan

[21] Appl. No.: 09/173,886

[22] Filed: Oct. 16, 1998

[51] Int. Cl.[7] ..... B68B 1/06

[52] U.S. Cl. ..... 54/8

[58] Field of Search ..... 54/7, 8, 9

[56] References Cited

U.S. PATENT DOCUMENTS 492,666 2/1893 Driscoll ..... 54/8

799,602 9/1905 Johnson ..... 54/8

3,851,446 12/1974 Bischeltsrieder ..... 54/8

5,357,735 10/1994 Fry ..... 54/9

*Primary Examiner*—Robert P. Swiatek

*Attorney, Agent, or Firm*—Antonio R. Durando

[57] ABSTRACT

A bit has two cheeks which are rotatably mounted in respective sleeves. The sleeves are connected to one another by a mouth having an adjustable width. Each of the sleeves is rotatable independently of the other on an axis extending in a direction from one of the sleeves to the other.

23 Claims, 3 Drawing Sheets

ROTATABLE, ADJUSTABLE-WIDTH BAR BIT

BACKGROUND OF THE INVENTION

1. Field of the Invention

The invention relates to a bit.

2. Description of the Prior Art

A bit generally consists of a mouth and two cheeks. The mouth is inserted in the mouth of an animal to be ridden and has approximately the same width as the animal's mouth. One cheek is mounted at either end of the mouth of the bit, and the cheeks are designed to sit adjacent to the sides of the animal's mouth. The cheeks are generally normal to the mouth of the bit and are rotatable on respective axes which are approximately perpendicular to the mouth. A chain extends between the cheeks and one or more reins are attached to each cheek.

The width of the mouth in a conventional bit is fixed. Since the mouths of animals to be ridden vary in size, the bits are thus made in several widths. Inasmuch as a bit of particular width can only be employed for a limited number of animals to be ridden, these conventional bits are not very versatile.

When a rein attached to a cheek is pulled, the cheek has a tendency to rotate on an axis generally paralleling the mouth of the bit.

Since the mouth and cheeks in a conventional bit are fixed against relative rotation on such an axis, the pull causes the mouth of the bit to move backward. This is uncomfortable for the animal being ridden.

SUMMARY OF THE INVENTION

It is an object of the invention to increase the versatility of a bit.

Another object of the invention is to increase the comfort of a bit for an animal being ridden.

The preceding objects, as well as others which will become apparent as the description proceeds, are achieved by the invention.

One aspect of the invention resides in a bit. The bit comprises an assembly having a first end, a second end, and a mouth portion for insertion in the mouth of an animal. The bit further comprises a first member at the first end for engagement with a rein, and a second member at the second end for engagement with a rein.

In one embodiment of the bit, the assembly includes means for changing the distance between the two ends of the assembly.

Changing the distance between the ends of the assembly changes the width of the bit. This enables the bit to be used for animals with different mouth sizes thereby making the bit quite versatile.

In another embodiment of the bit, the assembly with the mouth portion includes a first section containing the first end of the assembly and a second section containing the second end of the assembly. The first and second sections are rotatable relative to one another.

By designing the first and second sections to be rotatable relative to one another on an axis running in a direction from one end of the assembly towards the other, the members which are provided for the reins and are located at the ends of the assembly likewise become rotatable relative to each other on this axis. Hence, when a rein attached to one of the members is pulled, this member is able to rotate with respect to the other member and with respect to the section of the assembly on which the other member is mounted. The bit thus does not move backward in response to the pull or, at least, does not move backward as far as a conventional bit. Consequently, this embodiment of the bit of the invention can reduce discomfort for an animal being ridden.

Another aspect of the invention resides in a method of manipulating a bit which, as above, includes an assembly having a first end, a second end, and a mouth portion for insertion in the mouth of an animal.

One embodiment of the method comprises the step of changing the distance between the ends of the assembly.

The changing step may include moving cooperating portions of the assembly relative to one another. Such moving can involve screwing one of the cooperating portions into or out of the other of the cooperating portions.

This embodiment of the method may additionally comprise the steps of fixing the cooperating portions to one another, and releasing the cooperating portions from each other.

When the bit has first and second members which are located at the ends of the assembly and are designed for engagement by reins, the instant embodiment of the method may further comprise the step of rotating at least part of the mouth portion of the assembly relative to such members.

As mentioned earlier, the assembly may include a first section containing the first end thereof and a second section containing the second end thereof. Another embodiment of the method then comprises the step of rotating the first and second sections relative to one another.

The first and second sections may be rotated on an axis extending in a direction from one end of the assembly towards the other. It is preferred for the first and second sections to be rotated substantially independently of one another. Advantageously, the first and second sections are restrained against substantial movement towards and away from each other.

The features of the different embodiments of the bit can be combined as can the features of the different embodiments of the method.

Additional features and advantages of the invention will be forthcoming from the following detailed description of preferred embodiments when read in conjunction with the accompanying drawings.

DESCRIPTION OF THE PREFERRED EMBODIMENTS

Figure 1:
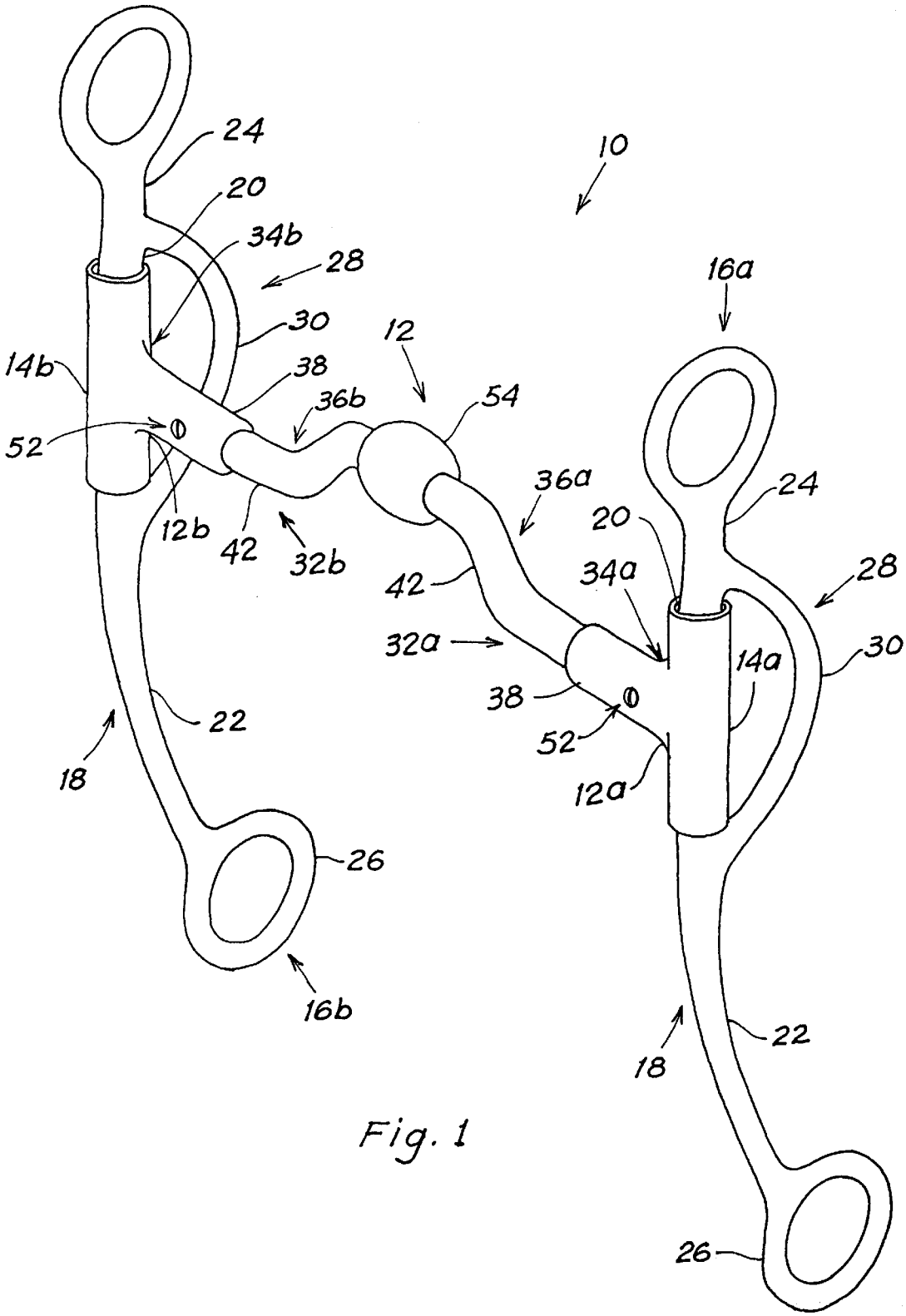
FIG. 1 is a perspective view of a bit in accordance with the invention.

Referring to FIG. 1, the numeral 10 identifies a bit according to the invention. The bit 10 includes an elongated assembly 12 having opposite longitudinal ends 12*a* and 12*b*. A sleeve or holding element 14*a* is located at the end 12*a* and a second sleeve or holding element 14*b* is located at the end 12*b*. The sleeves 14*a*,14*b* are perpendicular or approximately perpendicular to a line joining the ends 12*a*,12*b*.

A cheek or anchoring member 16*a* is mounted in the sleeve 14*a* and a second cheek or anchoring member 16*b* is mounted in the sleeve 14*b*. Each of the cheeks 16*a*,16*b* includes a rod 18 having a straight upper portion 20 and a curved lower portion 22. The straight portions 20 are received in the sleeves 14*a*,14*b* with clearance so that the cheeks 16*a*,16*b* are freely rotatable in the sleeves 14*a*,14*b* on axes normal to a line joining the ends 12*a*,12*b* of the assembly 12.

An upper eye 24 is disposed at the upper end of each rod 18, a lower eye 26 at the lower end, and a middle eye 28 at the level of the respective sleeve 14*a*,14*b*. Each of the middle eyes 28 is formed by the straight portion 20 of the respective rod 18 and a curved rod segment 30 which is joined to the straight portion 20 above and below the respective sleeve 14*a*,14*b*.

Figure 2:
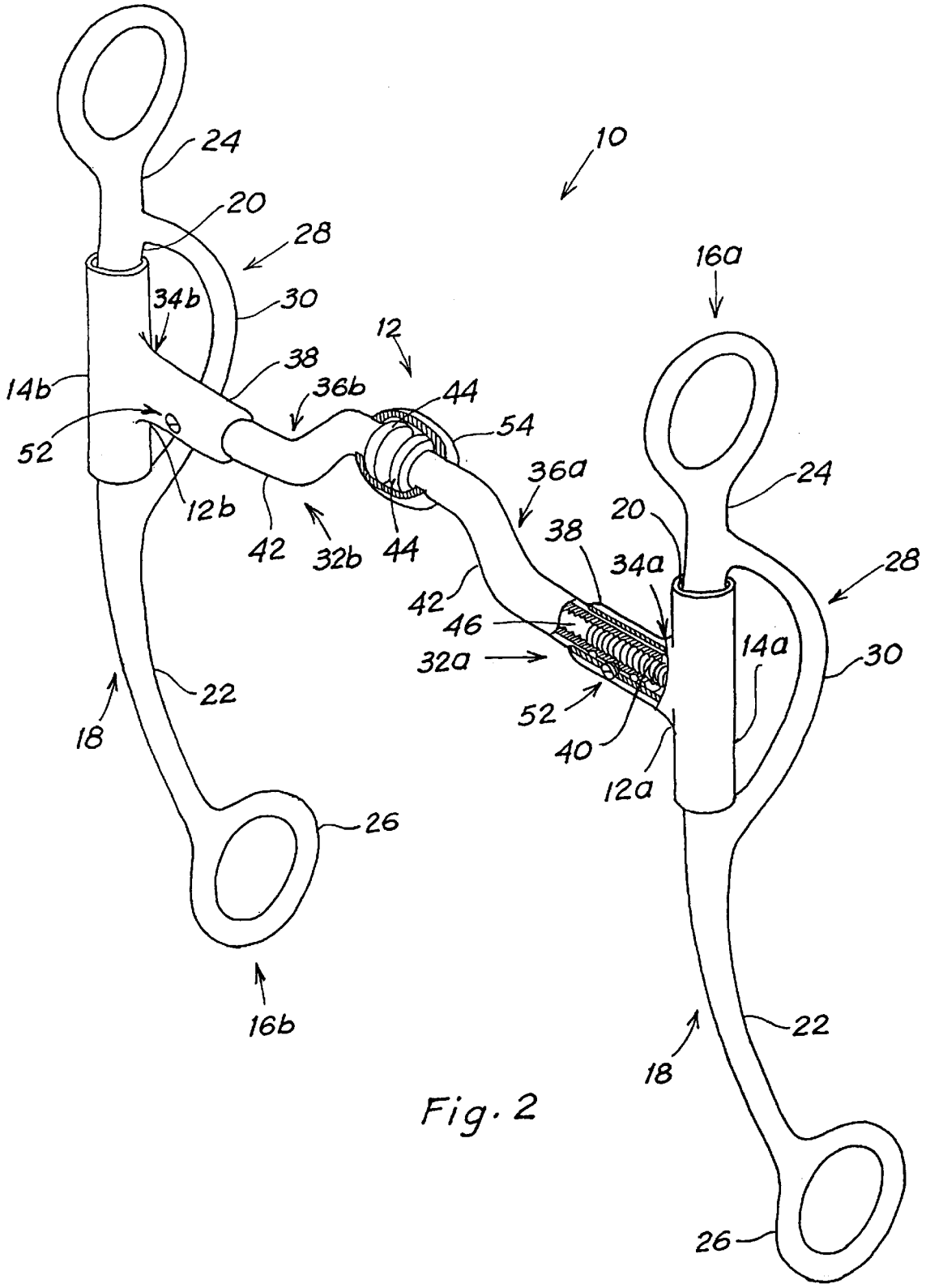
FIG. 2 is similar to FIG. 1 but shows portions of the bit cut away.
Figure 3:
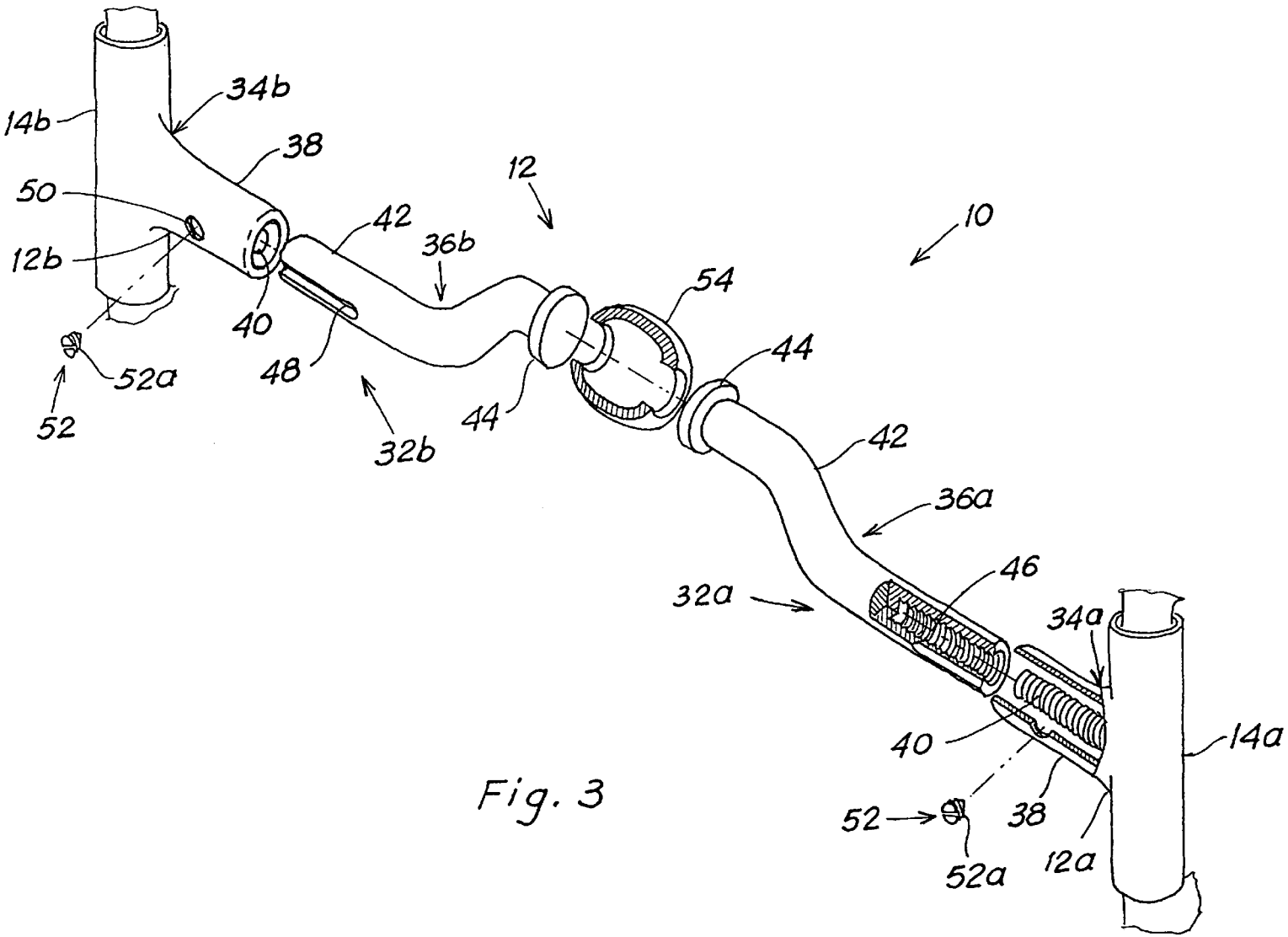
FIG. 3 is an exploded view of the bit of FIG. 1.

Considering FIGS. 2 and 3 in conjunction with FIG. 1, the assembly 12 comprises two separate sections 32*a* and 32*b*. The section 32*a* is made up of two separate parts 34*a* and 36*a* while the section 32*b* is made up of two separate parts 34*b* and 36*b*.

The part 34*a* includes the sleeve 14*a*, a tubular housing or protrusion 38 which projects from the sleeve 14*a* towards the sleeve 14*b*, and a threaded shaft 40 which is located inside the housing 38. The threaded shaft 40 is mounted on the sleeve 14*a* and extends from the latter along the axis of the housing 38. An annular gap exists between the housing 38 and the threaded shaft 40, and the end of the housing 38 remote from the sleeve 14*a* is open. The part 34*b*, in which the sleeve 14*b* replaces the sleeve 14*a*, is identical to the part 34*a*. Except for the sleeve 14*b*, the reference numerals used for the part 34*b* are the same as those for the part 34*a*.

The part 36*a* comprises a rod or elongated element 42 which has been bent into a shape resembling a flattened S or an inverted flattened S depending upon how the element 42 is viewed. One end of the S-shaped element 42 faces the sleeve 14*b* and is provided with a collar or head 44. The other end of the S-shaped element 42 faces the sleeve 14*a*, and a threaded passage 46 extends from this end away from the sleeve 14*a*. The end of the threaded passage 46 facing the sleeve 14*a* is open, and the threads in the passage 46 are designed to mesh with the threads on the shaft 40 extending from the sleeve 14*a*. The outer diameter of the S-shaped element 42 is smaller than the inner diameter of the housing 38 protruding from the sleeve 14*a*. Thus, the segment of the S-shaped element 42 with the threaded passage 46 can enter this housing 38 to allow the shaft 40 to be screwed into the passage 46.

The part 36*b* is identical to the part 36*a*, and the same reference numerals are employed for the part 36*b* as for the part 36*a*.

A threaded passage 46 and respective shaft 40 constitute cooperating portions of the assembly 12 and serve as a means for changing the distance between the ends 12*a*,12*b* of the assembly 12. When the distance between the ends 12*a*,12*b* is changed, the width of the bit 10 is changed. Accordingly, the threaded passages 46 and threaded shafts 40 make it possible to adjust the width of the bit 10 to the width of the mouth of an animal to be ridden. The width of the bit 10 can be decreased by screwing the shafts 40 inward of the passages 46 and, conversely, the width of the bit 10 can be increased by screwing the shafts 40 outward of the passages 46. A shaft 40 may be screwed inward and outward of the respective passage 46 by rotating the parts 34*a*,36*a* or the parts 34*b*,36*b* relative to one another on the axis of the respective shaft 40.

Each of the S-shaped elements 42 is provided with a pair of diametrically opposed grooves at the outer surface thereof. One of the grooves is visible in FIG. 3 and is identified by the numeral 48. The grooves 48 extend alongside the threaded passages 46 in parallelism therewith.

Each of the housings 38 is formed with a threaded hole or opening 50 which is perpendicular to the respective threaded shaft 40 and passes completely through the wall of the respective housing 38. Arresting or fixing elements 52 having threaded shanks 52*a* can be screwed into the holes 50. The shanks 52*a* are designed to project from the holes 50 into the grooves 48 upon alignment of the grooves 48 with the holes 50. The arresting elements 52 function to releasably fix the parts 34*a*,36*a*, as well as the parts 34*b*,36*b*, against relative rotation on the axes of the shafts 40. By preventing relative rotation of the parts 34*a*,36*a*, and of the parts 34*b*,36*b*, on the axes of the shafts 40, the arresting elements 52 effectively fix the parts 34*a*,36*a*, as well as the parts 34*b*,36*b*, against relative displacement axially of the shafts 40.

The arresting elements 52 can, for example, be set screws.

As indicated previously, the ends of the S-shaped elements 42 remote from the threaded passages 46 are provided with collars 44. Such ends of the S-shaped elements 42 face and are located adjacent to each other. The collars 44 are enclosed by a housing 54 having two openings which face the sleeves 14*a* and 14*b*, respectively, and are in register with one another. One of the S-shaped elements 42 passes through each of the openings, and the diameters of the openings are slightly larger than the diameters of the S-shaped elements 42.

The collars 44 are confined in the housing 54 with only a minimal clearance radially of the collars 44 and housing 54. Moreover, the housing 54 is configurated in such a manner that the collars 44 are separated by a small gap and can undergo little, if any, movement towards and away from one another.

The collars 44 and housing 54 cooperate to define an axis of rotation passing through the centers of the openings in the housing 54 and extending in a direction from one of the ends 12*a*,12*b* of the assembly 12 towards the other. The housing 54 is designed so that each of the S-shaped elements 42, and hence each of the sections 32*a*,32*b* of the assembly 12, is freely rotatable on this axis through an angle of 360 degrees. Furthermore, the sections 32*a*,32*b* can be rotated on such axis essentially independently of one another.

The normal operating position of the bit 10 is as shown in FIG. 1 with the curved portions 22 of the cheeks 16*a*,16*b* below the straight portions 20 and the housing 54 above the axes of the threaded shafts 40. The placement of the housing 54 above the axes of the shafts 40 is accomplished by properly positioning one of the grooves 48 in each of the S-shaped elements 42 relative to the respective threaded hole 50.

It is sometimes desirable for the housing 54 to be located below the axes of the shafts 40. This can be achieved by loosening the arresting elements 52 and rotating the housing 54, together with the S-shaped elements 42, through 180 degrees relative to the housings 38. As a result, the second groove 48 in each of the S-shaped elements 42 comes into register with the respective threaded hole 50.

The portion of the assembly 12 between the sleeves 14*a*,14*b* will generally be inserted in the mouth of an animal to be ridden and can be considered to constitute the mouth of the bit 10.

Assuming that a rider has selected an animal to be ridden, the operation of the bit 10 is as follows:

The rider loosens the arresting elements 52 and rotates the parts 34*a*,36*a*, as well as the parts 34*b*,36*b*, relative to each other in order to adjust the width of the bit 10 to the width of the mouth of the animal. Once the proper width of the bit 10 has been achieved, the position of the housing 54 is adjusted so that the latter is located above the axes of the threaded shafts 40 when the curved portions 22 of the cheeks 16*a,*16*b* are located below the straight portions 20. Adjustment of the housing 54 is accomplished by rotating the housing 54 and S-shaped elements 42 relative to the housings 38 in order to bring the proper grooves 48 into alignment with the threaded holes 50. The arresting elements 52 are thereupon tightened.

A chain is suspended from the upper eyes 24 and a rein is tied to each of the middle eyes 28 and each of the lower eyes 26. The portion of the bit 10 between the sleeves 14*a,*14*b* is inserted in the animal's mouth in such a manner that the housing 54 is situated above the axes of the threaded shafts 40 and the curved portions 22 of the cheeks 16*a,*16*b* are situated below the straight portions 20. The rider mounts the animal and grasps the reins attached to the cheeks 16*a,*16*b*.

The cheeks 16*a,*16*b* are free to rotate in the sleeves 14*a,*14*b*. Furthermore, each of the cheeks 16*a,*16*b* is free to rotate independently of the other on the axis defined by the housing 54 and the collars 44 on the S-shaped elements 42. However, because the housing 54 essentially prevents movement of the S-shaped elements 42 towards and away from one another, the cheeks 16*a,*16*b* are essentially restrained against movement towards and away from each other.

When the rider pulls on the reins attached to the cheek 16*a,* the cheek 16*a* rotates on the axis defined by the collars 44 and housing 54. The cheek 16*b* is virtually unaffected by this rotation and essentially retains its position. Consequently, there is little, if any, tendency for the bit 10 to be drawn backwards by the pulling action and cause discomfort to the animal being ridden. This is in contrast to conventional bits where the cheeks are unable to rotate on an axis corresponding to that defined by the collars 44 and housing 54.

Similarly, when the rider pulls on the reins attached to the cheek 16*b,* the cheek 16*b* rotates on the axis defined by the collars 44 and housing 54. The cheek 16*a* is affected little, if any, by the rotation of the cheek 16*b* and essentially remains in position. Again, there is no, or virtually no, tendency for the bit 10 to be drawn backwards.

If it should become desirable for the housing 54 to be shifted to a position below the axes of rotation of the threaded shafts 40, the bit 10 is removed from the animal's mouth and the arresting elements 52 are loosened. The housing 54 and S-shaped elements 42 are then rotated 180 degrees relative to the housings 38 so that the grooves 48 opposite those previously in register with the threaded holes 50 are brought into alignment with the holes 50. The arresting elements 52 are thereupon retightened.

The bit 10 is quite versatile by virtue of the fact that the width of the bit 10 is adjustable. Thus, this allows the bit 10 to be used for many different animals. The versatility of the bit 10 is enhanced by the ability of the housing 54 to be positioned above or below the axes of rotation of the threaded shafts 40.

Moreover, the bit 10 makes it possible to reduce the discomfort of an animal being ridden. This is due to the ability of the cheeks 16*a,*16*b* to rotate substantially independently of one another on an axis extending in a direction from one of the ends 12*a,*12*b* of the assembly 12 to the other. When the reins attached to one of the cheeks 16*a,*16*b* are pulled, the respective cheek 16*a,*16*b* will rotate on such axis thereby eliminating, or virtually eliminating, any tendency of the bit 10 to move backwards. Backward movement of a bit can increase the discomfort of an animal being ridden.

The bit 10 can be used for horses as well as other animals.

Various modifications are possible within the meaning and range of equivalence of the appended claims.

I claim:

1. A bit comprising:

an assembly having a mouth portion for insertion in the mouth of an animal, said assembly including a first section having a pair of first ends and a second section having a pair of second ends, said first section being discrete from said second section;

a first member at one of said first ends for engagement with a rein; and a second member at one of said second ends for engagement with a rein, said assembly including means for changing the distance between said ends, and said assembly further including a housing which confines the other of said first ends and the other of said second ends in such a manner that each of said sections is essentially freely rotatable substantially independently of the other of said sections on an axis extending at least approximately in a direction from said one first end towards said one second end.

2. The bit of claim 1, wherein each of said first and second sections is essentially freely rotatable through 360 degrees on an axis extending at least approximately in a direction from said one first end towards said one second end.

3. The bit of claim 1, wherein at least one of said sections has a first part and a second part, said changing means including relatively movable cooperating portions on said first and second parts.

4. The bit of claim 3, wherein said cooperating portions comprise a threaded shaft on one of said parts and a threaded passage in the other of said parts.

5. The bit of claim 4, wherein said one part comprises an additional housing for said shaft, said other part being insertable in said additional housing.

6. The bit of claim 4, wherein said one part comprises a holding element for one of said members, said shaft being mounted on said holding element.

7. The bit of claim 3, wherein said assembly comprises means for releasably fixing said cooperating portions to each other.

8. The bit of claim 7, wherein said fixing means comprises a groove on opposite sides of one of said cooperating portions, and an arresting element engageable with the other of said cooperating portions and receivable in the grooves.

9. The bit of claim 1, wherein said assembly comprises relatively rotatable cooperating portions arranged to permit rotation of at least part of said mouth portion relative to said members.

10. A bit comprising:

an assembly having a mouth portion for insertion in the mouth of an animal, said assembly including a first section having a first end and a second section having a second end, and said sections being rotatable relative to one another;

a first member at said first end for engagement with a rein; and a second member at said second end for engagement with a rein, said assembly including means for changing the distance between said ends, and said first section having an additional end adjacent to said second section while said second section has an additional end adjacent to said first section, said assembly including a housing which confines said additional ends and cooperates therewith to essentially prevent movement of said first and second sections towards and away from one another.

11. The bit of claim 10, wherein said housing cooperates with said additional ends to define an axis extending in a direction from said first end towards said second end, said first and second sections being rotatable relative to one another on said axis.

12. A bit comprising:

an assembly having a mouth portion for insertion in the mouth of an animal, said assembly having a first end and a second end;

a first member at said first end for engagement with a rein; and a second member at said second end for engagement with a rein, said assembly including means for changing the distance between said ends, and said assembly having a first part and a second part, said changing means comprising relatively movable cooperating portions on said first and second parts, and said cooperating portions including a threaded shaft on one of said parts and a threaded passage in the other of said parts, said one part comprising a holding element for one of said members, and said shaft being mounted on said holding element, said holding element including a sleeve and said one member being rotatably mounted in said sleeve.

13. A bit comprising:

an assembly having a mouth portion for insertion in the mouth of an animal, said assembly including a first section having a pair of first ends and a second section having a pair of second ends, said first section being discrete from said second section;

a first member at one of said first ends for engagement with a rein; and a second member at one of said second ends for engagement with a rein, said assembly including a housing which confines the other of said first ends and the other of said second ends in such a manner that each of said sections is essentially freely rotatable substantially independently of the other of said sections on an axis extending at least approximately in a direction from said one first end towards said one second end.

14. The bit of claim 13, wherein each of said first and second sections is essentially freely rotatable through 360 degrees on an axis extending at least approximately in a direction from said one first end towards said one second end.

15. The bit of claim 13, wherein said assembly comprises relatively rotatable cooperating portions arranged to permit rotation of at least part of said mouth portion relative to said members.

16. A bit comprising:

an assembly having a mouth portion for insertion in the mouth of an animal, said assembly including a first section having a first end and a second section having a second end, and said sections being rotatable relative to one another;

a first member at said first end for engagement with a rein; and a second member at said second end for engagement with a rein, said first section having an additional end adjacent to said second section while said second section has an additional end adjacent to said first section, and said assembly including a housing which confines said additional ends and cooperates therewith to essentially prevent movement of said first and second sections towards and away from one another.

17. The bit of claim 16, wherein said housing cooperates with said additional ends to define an axis extending in a direction from said first end towards said second end, said first and second sections being rotatable relative to one another on said axis.

18. A bit comprising:

an assembly having a mouth portion for insertion in the mouth of an animal, said assembly having a first end and a second end;

a first member at said first end for engagement with a rein; and a second member at said second end for engagement with a rein, said assembly including a first section having said first end and a second section having said second end, and said first and second sections being rotatable relative to one another, said assembly further including means for changing the distance between said ends, and at least one of said sections having a first part and a second part, said changing means comprising relatively movable cooperating portions on said first and second parts, and said cooperating portions including a threaded shaft on one of said parts and a threaded passage in the other of said parts, said one part comprising a housing for said shaft, and said other part being insertable in said housing.

19. A bit comprising:

an assembly having a mouth portion for insertion in the mouth of an animal, said assembly having a first end and a second end;

a first member at said first end for engagement with a rein; and a second member at said second end for engagement with a rein, said assembly including a first section having said first end and a second section having said second end, and said first and second sections being rotatable relative to one another, said assembly further including means for changing the distance between said ends, and at least one of said sections having a first part and a second part, said changing means comprising relatively movable cooperating portions on said first and second parts, and said cooperating portions including a threaded shaft on one of said parts and a threaded passage in the other of said parts, said one part comprising a holding element for one of said members, and said shaft being mounted on said holding element.

20. The bit of claim 19, wherein said holding element comprises a sleeve and said one member is rotatably mounted in said sleeve.

21. A bit comprising:

an assembly having a mouth portion for insertion in the mouth of an animal, said assembly having a first end and a second end;

a first member at said first end for engagement with a rein; and a second member at said second end for engagement with a rein, said assembly including means for changing the distance between said ends, and said assembly having a first part and a second part, said changing means comprising a shaft of predetermined length on one of said parts, and said one part including a housing for said shaft which extends substantially entirely along said predetermined length thereof, said shaft and said housing being of one piece.

22. The bit of claim 21, wherein said shaft is threaded and said changing means further comprises a threaded passage in the other of said parts designed to mesh with said shaft, said other part being insertable in said housing.

23. A bit comprising:

an assembly having a mouth portion for insertion in the mouth of an animal, said assembly having a first end and a second end;

a first member at said first end for engagement with a rein; and a second member at said second end for engagement with a rein, said assembly including means for changing the distance between said ends, and said assembly having a first part and a second part, said changing means comprising relatively movable cooperating portions on said first and second parts, and said assembly including means for releasably fixing said cooperating portions to each other, said fixing means comprising a first groove through a first side of one of said cooperating portions, a second groove through an opposed second side of said one cooperating portion and an arresting element engageable with the other of said cooperating portions and receivable in said grooves.

* * * * *